US011326260B1

(12) United States Patent
Zhou et al.

(10) Patent No.: US 11,326,260 B1
(45) Date of Patent: May 10, 2022

(54) RARE EARTH METAL OXIDE COATINGS PREPARED WITH RARE EARTH METAL NITRATE OR ACETATE SOLUTIONS FOR IMPROVING HIGH TEMPERATURE OXIDATION AND CORROSION OF STAINLESS STEELS

(71) Applicant: AK Steel Properties, Inc., West Chester, OH (US)

(72) Inventors: Zhuangfei Zhou, Franklin, OH (US); Frederick Alan Myers, Middletown, OH (US); Amanda R. Glass, Springboro, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 279 days.

(21) Appl. No.: 15/935,800

(22) Filed: Mar. 26, 2018

Related U.S. Application Data

(60) Provisional application No. 62/476,322, filed on Mar. 24, 2017.

(51) Int. Cl.
*B32B 27/02* (2006.01)
*C23F 11/18* (2006.01)

(52) U.S. Cl.
CPC ..... *C23F 11/18* (2013.01)

(58) Field of Classification Search
CPC ..... C23C 28/00; C23C 8/80
See application file for complete search history.

(56) References Cited

U.S. PATENT DOCUMENTS 8,568,538 B2 10/2013 Kerber

OTHER PUBLICATIONS

Aghazadeh, M., et al., "Yttrium Oxide Nanoparticles Prepared by Heat Treatment of Cathodically Grown Yttrium Hydroxide," International Scholarly Research Network Ceramics, Sep. 7, 2011, pp. 1-6.

Cambon, J., et al., "Effect of Cerium Concentration on Corrosion Resistance and Polymerization of Hybrid Sol-Gel Coating on Martensitic Stainless Steel," Progress in Organic Coatings, Elsevier, 2012, pp. 486-493.

Gil, A., et al., "Improving the Oxidation Resistance and Electrical Properties of Ferritic Stainless Steels for Application in SOFC Interconnects," Oxidation of Metals, Feb. 2016, vol. 85, Issue 1-2, pp. 151-169.

Bonnet, G., et al., "The Effect of Rare Earths Deposited on Steel Surfaces, by Different Processes (SOL/GEL, Electrophoresis, OMCVD), on High Temperature Corrosion Behavior", 1993, Corrosion Science, vol. 35, Nos. 5-8, pp. 893-899.

*Primary Examiner* — Lawrence D Ferguson
(74) *Attorney, Agent, or Firm* — Frost Brown Todd LLC

(57) ABSTRACT

To improve oxidation and corrosion resistance of stainless steel, it is not necessary to apply suspensions containing nanoparticles of rare earth metal oxides. Rare earth metal nitrates or acetates in aqueous solution improve the oxidation and corrosion resistance of stainless steels when applied to the surface of the steels. Further oxidation and corrosion resistance can be provided by the addition of chromium or aluminum acetate, nitrate, or sulfate to the rare earth metal nitrate or acetate aqueous solutions before application to the steel.

4 Claims, 10 Drawing Sheets

Coated below

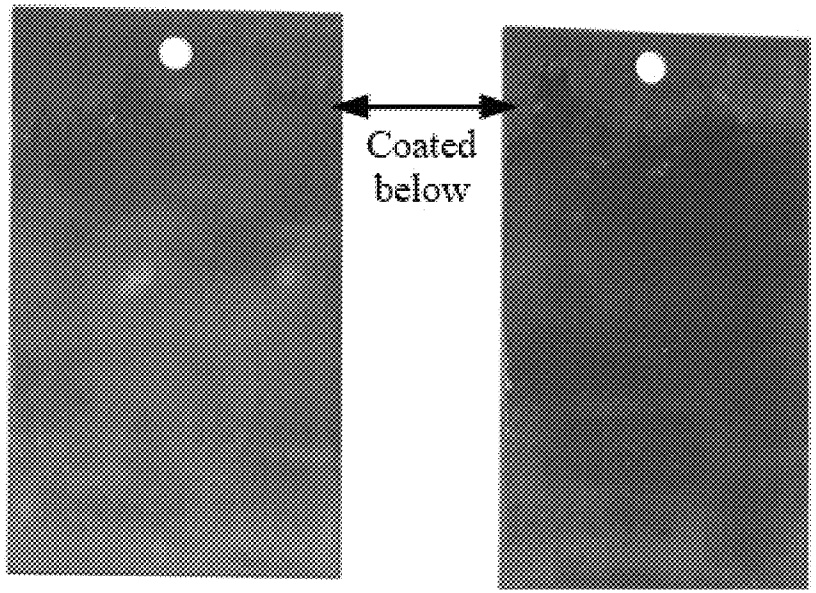
Fig. 7c
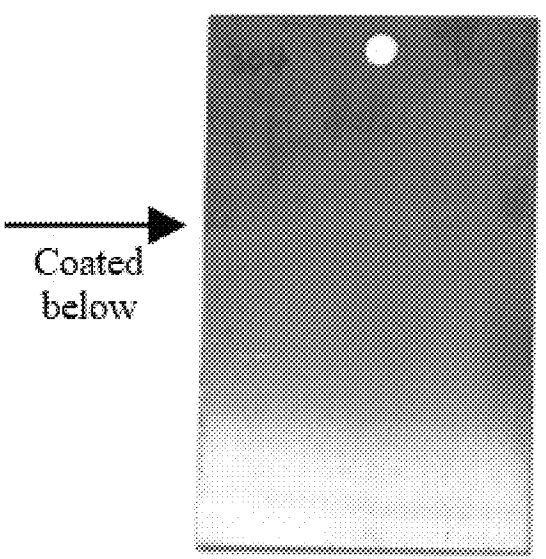
Fig. 7b
Fig. 7a

RARE EARTH METAL OXIDE COATINGS PREPARED WITH RARE EARTH METAL NITRATE OR ACETATE SOLUTIONS FOR IMPROVING HIGH TEMPERATURE OXIDATION AND CORROSION OF STAINLESS STEELS

PRIORITY

This application claims priority to U.S. Provisional Application Ser. No. 62/476,322, filed Mar. 24, 2017, entitled "Rare Earth Metal Oxide Coatings Prepared With Metal Salt Solutions For Improving High Temperature Oxidation Of Stainless Steels," the disclosure of which is incorporated by reference herein.

BACKGROUND

The present application relates to use of rare earth metal nitrate or acetate aqueous solutions to provide oxidation and corrosion resistance to stainless steels without the need to use proprietary solutions comprising nanoparticles of rare earth metal oxides.

Minimox® liquid, available from Materials Interface, Inc. of Sussex, Wis., comprises nano-particles of rare earth oxide in suspension. Such materials are also described in U.S. Pat. No. 8,568,538. It is believed that Minimox contains up to about 1% by weight yttrium as $Y_2O_3$ nanoparticles that are suspended in an aqueous medium.

Minimox liquid can be applied to a stainless steel surface by dipping, painting, and spraying. After air drying, the oxide nanoparticles are believed to remain on the steel surface and become incorporated into the surface oxide, $Cr_2O_3$, of the stainless steel through diffusion at high service temperatures. This incorporation modifies the surface oxide making it more adherent and more resistant to high temperature oxide.

SUMMARY

In the present embodiments, it has been determined that the application of nanoparticles of rare earth metal oxides in suspension is unnecessary to provide oxidation and corrosion resistance to stainless steels because the beneficial effect can be achieved with rare earth metal nitrates or acetates dissolved in a simple aqueous solution without first converting to oxide nanoparticles. It has been unexpectedly determined that rare earth metal nitrates or acetates in aqueous solution improve the oxidation and corrosion resistance of stainless steels when applied directly to the surface of the steels. Further oxidation and corrosion resistance can be provided by the addition of chromium or aluminum nitrates, acetates, or sulfates to the rare earth metal nitrate or acetate aqueous solutions before application to the steel.

DESCRIPTION OF DRAWINGS

FIG. 7*a* depicts one embodiment showing yttrium nitrate coated 304 stainless steel, FIG. 7*b* depicts an embodiment showing a first chromium nitrate coated 409 stainless steel, FIG. 7*c* depicts another embodiment showing a second chromium nitrate coated 409 stainless steel.

DETAILED DESCRIPTION

Figure 1:
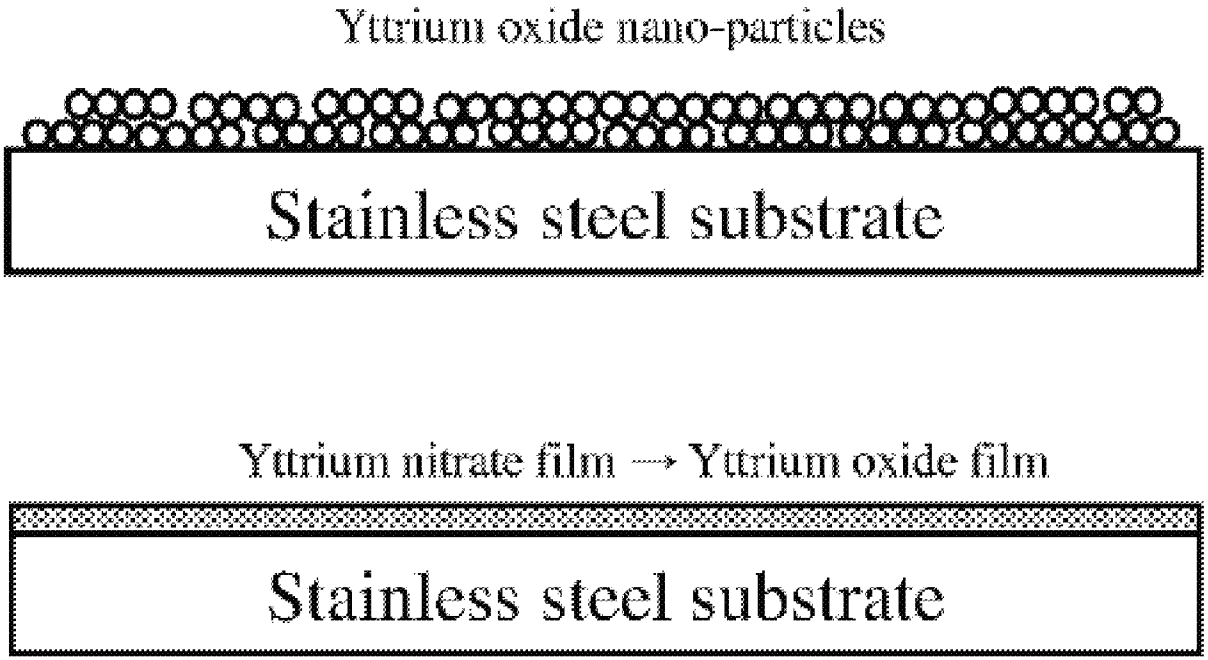
FIG. 1 depicts a schematic illustration of Minimox yttrium oxide nano-particle coating and the rare earth metal nitrate/oxide coating of the present embodiments, such as a yttrium nitrate/yttrium oxide coating.

Application of aqueous rare earth metal nitrate or acetate solutions to stainless steel improves oxidation and corrosion resistance of the steel.

An embodiment of the present invention comprises an aqueous solution of rare earth metal nitrate or acetate. The rare earth metal comprising the salt can include one or more of cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb) and yttrium (Y). The salt can be nitrates or acetates. Chlorides were found to permit corrosion and carbonates were found to be not soluble, thus, in the present application rare earth metal salts do not include carbonates or chlorides.

Rare earth metal salts are well known in the industry and commercially available. It is not necessary that the nitrate or acetates be of any particular grain size, and particularly there is no need for the salts, or the resulting rare earth metal oxides, to be limited to nanoparticles, which are considered to be particles with dimensions in the range of 1 to 100 nm.

The solution comprises rare earth metal nitrate or acetate dissolved in water, preferably deionized water. The concentration of the rare earth metal nitrate or acetate in the aqueous solution can extend to the limits of solubility of the particular salt. In certain embodiments, a solution can have a concentration equal to about 1 to about 10 g of rare earth metal nitrate or acetate to about 200 g of total aqueous solution. In other embodiments, a solution can have a concentration equal to about 1 to about 20 g of rare earth metal nitrate or acetate to about 200 g of total aqueous solution.

In some embodiments, the amount of the rare earth metal nitrate or acetate that is applied to the stainless steel surface is sufficient to create, after heating, an oxide on the surface of the steel that has a density of about 300 to 3000 $\mu g/m^2$, or in some embodiments a density of about 500-1000 $\mu g/m^2$.

To improve wetting of the stainless steel, a surfactant may be added to the aqueous solution. Surfactants are added to a concentration of about 0.1% to 5% by weight of solution, and in some embodiments, in a concentration of about 0.1% to 0.5% by weight of solution. Any surfactant known to enhance wetting of an aqueous solution onto a stainless steel surface can be used. The surfactant may comprise a detergent, such as dish washing detergent.

In some embodiments, a chromium or aluminum salt may be added to the rare earth metal nitrate or acetate aqueous solution. The chromium or aluminum salt can be an acetate, a nitrate, or a sulfate. The chromium acetate, nitrate, or sulfate can be added in amounts of about 1% to 35% by weight of the total aqueous solution. The aluminum acetate, nitrate, or sulfate can be added in amounts of about 1% to about 5% by weight of the total aqueous solution. It is believed that the chromium or aluminum salt has a synergistic effect when combined with the rare earth metal salt in solution and further improves the oxidation and corrosion resistance of the stainless steel.

The resulting aqueous solution can be applied to one or both surfaces of a stainless steel strip (or to any other stainless steel product) by any method known to evenly apply liquids to a surface, including brushing, sponging, spraying, and dipping.

It is believed the present invention benefits all types of stainless steel. The stainless steels that benefit from the present embodiments include ferritic, austenitic, and martensitic stainless steels.

The difference between the rare earth metal nitrate or acetate aqueous solution coatings of this application and Minimox coating is explained in part by FIG. 1. Minimox contains nano-yttrium oxide particles that are suspended in water based mediums. When applied to the surface of stainless steels, the surfactant in Minimox aids in wetting the surface and spreads the liquid over the surface. Upon drying the nano-particles are laid and spread over the steel surface.

The surfactant, such as dishwashing detergent, in the embodiments of the present application, such as, an yttrium nitrate aqueous solution also help wet the steel surface. Once dried, however, with embodiments of the present application, a continuous film of yttrium nitrate, for example, is left on the surface of steel substrate. This is a fundamental difference between a Minimox coating and a rare earth metal salt coating.

At high temperatures, metal nitrates like $Y(NO_3)_3$ will decompose as follows.

$$2Y(NO_3)_3=Y_2O_3+6NO_2+3O_2$$

While $NO_2$ and $O_2$ escape as gas, the yttrium nitrate is oxidized to oxide.

A thin layer of yttrium oxide thus develops on the surface. This layer of yttrium oxide will react with the surface oxide of stainless steels through diffusion just like the yttrium oxide nano-particles from Minimox. The diffused yttrium oxide from Minimox or derived from a metal nitrate will subsequently improve the oxidation and corrosion resistance of the surface oxide of stainless steels. This beneficial effect has thus been observed in rare earth metal acetate or nitrate aqueous coatings, just as in Minimox.

EXAMPLES

Several embodiments of the rare earth metal salt aqueous solutions, such as yttrium chloride, yttrium nitrate and chromium nitrate, were prepared. Drops of dishwashing detergent were added to enhance wetting of the solutions on the stainless steel coupons. The stainless steel coupons were Type 304 stainless steel and Type 409 stainless steel, both provided by AK Steel Corporation, West Chester, Ohio.

The coatings were applied by dipping steel coupons in the salt solutions and pulling the coupon slowly out of solution.

The concentrations of yttrium and chromium in the solution were calculated as the weight percent of corresponding oxide such as 2% yttrium oxide, 5% chromium oxide, or 10% chromium oxide. Such calculations are well-known in the art. These concentrations are also referred to as "equivalent" concentrations. For each of the examples below, the yttrium nitrate solution (or 2% equivalent yttrium oxide solution) was made with 6.78 g $Y(NO_3)_3.6H_2O$ in a total of 200 g of solution. The yttrium chloride solution was made with 1.34 g $YCl_3.XH_2O$ in a total of 200 g of solution. The first chromium nitrate solution (or 5% equivalent chromium nitrate solution) was made with 26.33 g $Cr(NO_3)_3.9H_2O$ in a total of 200 g of solution. The second chromium nitrate solution (or 10% equivalent chromium nitrate solution) was made with 52.66 g $Cr(NO_3)_3.9H_2O$ in a total of 200 g of solution. The yttrium nitrate plus first chromium nitrate solution (or yttrium nitrate plus 5% equivalent chromium nitrate solution) was made with 6.78 g $Y(NO_3)_3.6H_2O$ plus 26.33 g $Cr(NO_3)_3.9H_2O$ in a total of 200 g of solution. The yttrium nitrate plus second chromium nitrate solution (or yttrium nitrate plus 10% equivalent chromium nitrate solution) was made with 6.78 g $Y(NO_3)_3.6H_2O$ plus 52.66 g $Cr(NO_3)_3.9H_2O$ in a total of 200 g of solution.

The coated coupons were heat treated in a furnace with air at different temperatures.

Example 1

In one example, an yttrium chloride coating was applied to determine how it would affect the surface oxidation of stainless steels. Yttrium chloride solution with a concentration equivalent to 2% yttrium oxide was coated by coating onto 304 and 409 stainless steel by dip-coating, and air dried. The coupons were then heat treated at 1700° F. for 20 hours.

Figures 2A, 2B:
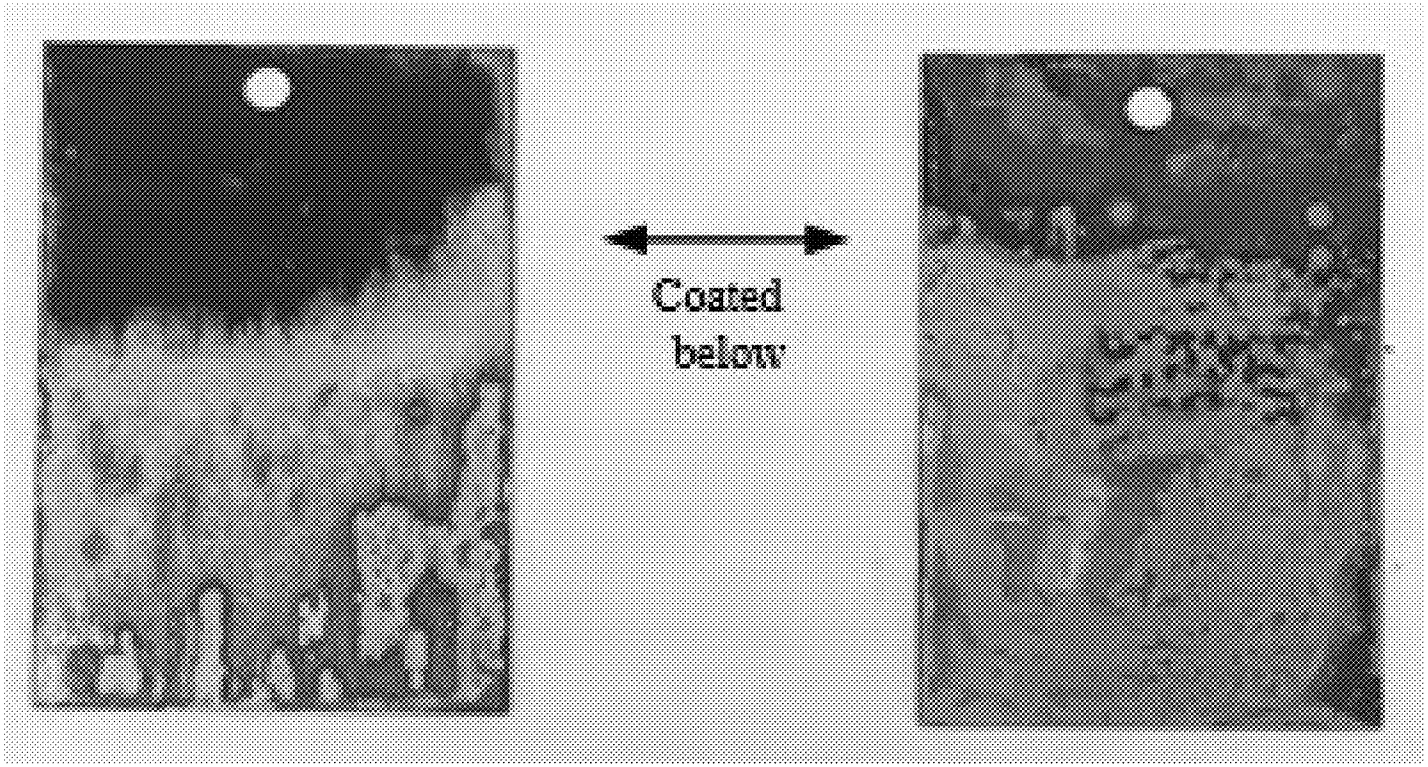
FIG. 2*a* depicts yttrium chloride coated 304 stainless steel and FIG. 2*b* depicts yttrium chloride coated 409 stainless steel, each heat treated at 1700° F. for 20 hours.

As shown in FIGS. 2*a* and 2*b*, the top section was uncoated and black oxide developed during the heat treatment. In contrast, the bottom section showed no black oxide but severe corrosion under microscope. This observation indicated that the chloride must have remained on the steel coupons at this temperature and caused the corrosion.

Example 2

Figure 3B:
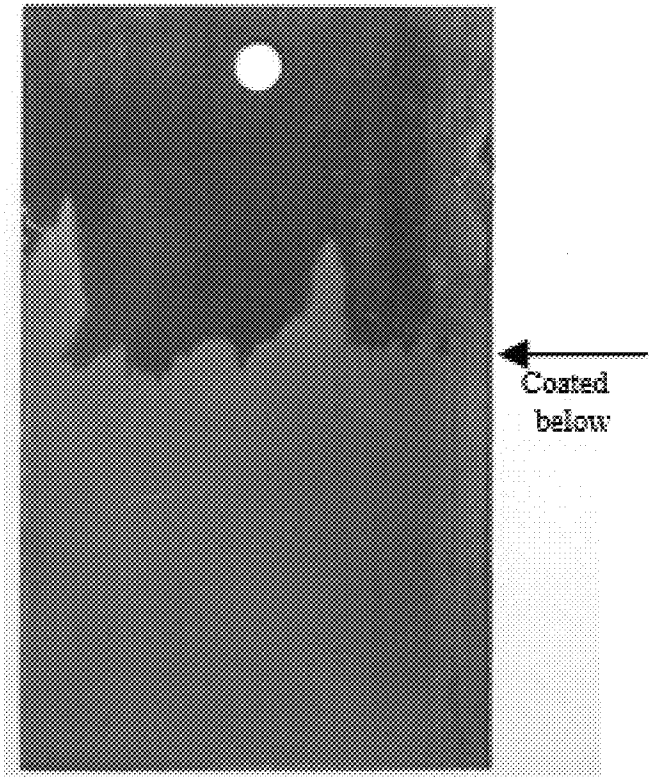
FIG. 3*a* depicts one embodiment showing yttrium nitrate coated 304 stainless steel and FIG. 3*b* depicts an embodiment showing yttrium nitrate coated 409 stainless steel, each heat treated at 1500° F. for 3 hours.
Figure 3A:
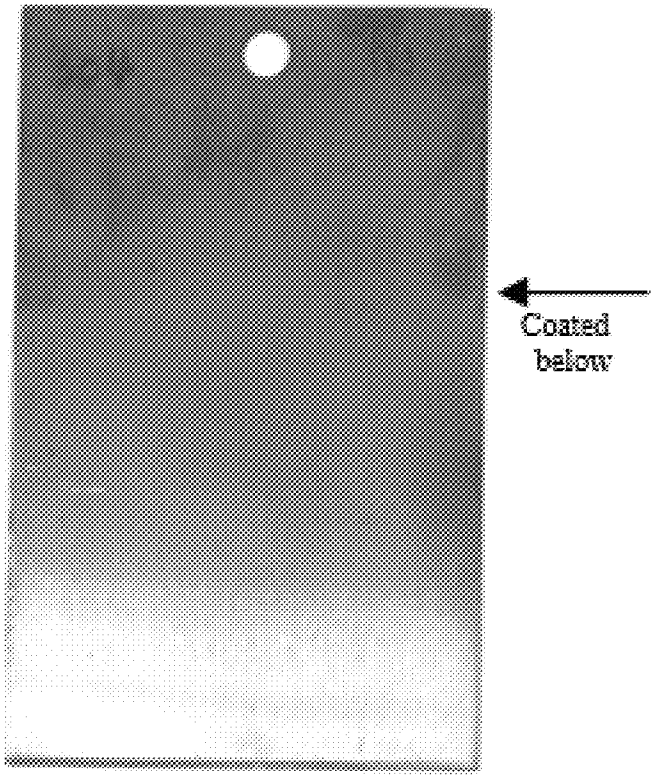
Figure 4B:
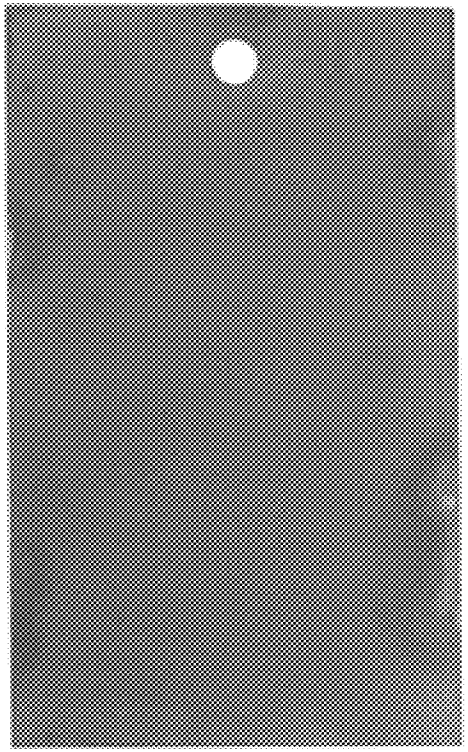
FIG. 4*a* depicts a bare 409 stainless steel coupon and FIG. 4*b* depicts an embodiment showing yttrium nitrated coated 409 stainless steel, each heat treated at 1500° F. for 20 hours.
Figure 4A:
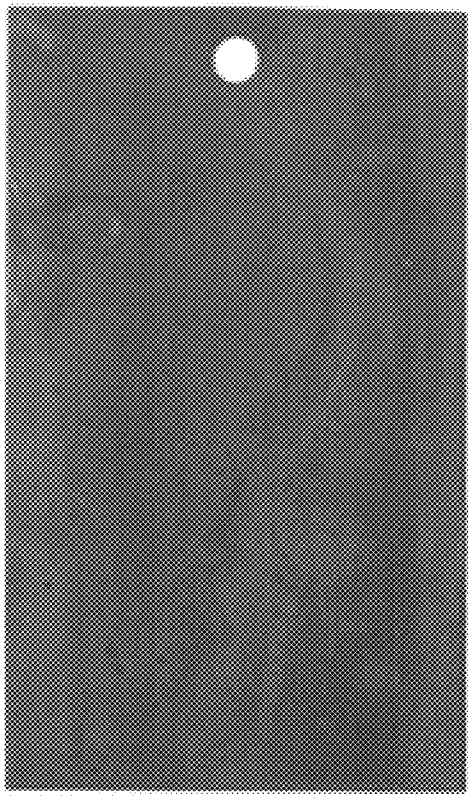

A solution comprising yttrium nitrate was tested. An yttrium nitrate coating was applied to the bottom sections of both 304 and 409 coupons and heated for 3 hours at 1500° F. FIGS. 3*a* and 3*b* show how yttrium nitrate coating impacted the oxidation of both 304 and 409 coupons. While the top section developed black scale, the coated bottom section remained shiny. As shown in FIGS. 4*a* and 4*b*, on a bare coupon and one coated with yttrium nitrate, on the coated coupon (FIG. 4*b*) the longer treatment after 20 hours at 1500° F. obscured the shiny surface but the grey scale of the yttrium nitrate coated bottom section was significantly smoother and showed no spalling, when compared to the bare coupon (FIG. 4*a*).

Example 3

Figure 5A:
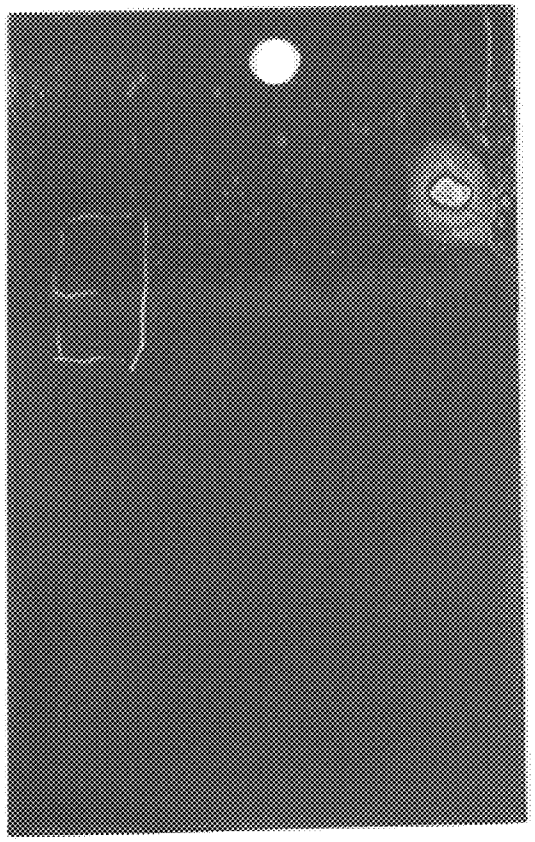
FIG. 5*a* depicts an embodiment showing yttrium nitrate coated 304 stainless steel that had been heated treated at 1700° F. for 20 hours.
Figure 5B:
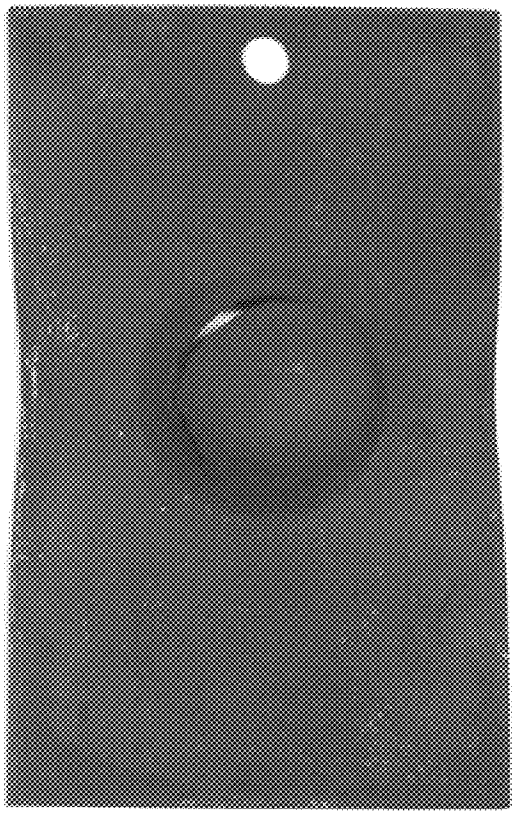
FIG. 5*b* depicts this embodiment after it was tested using an Olsen Cup tester.
Figure 6:
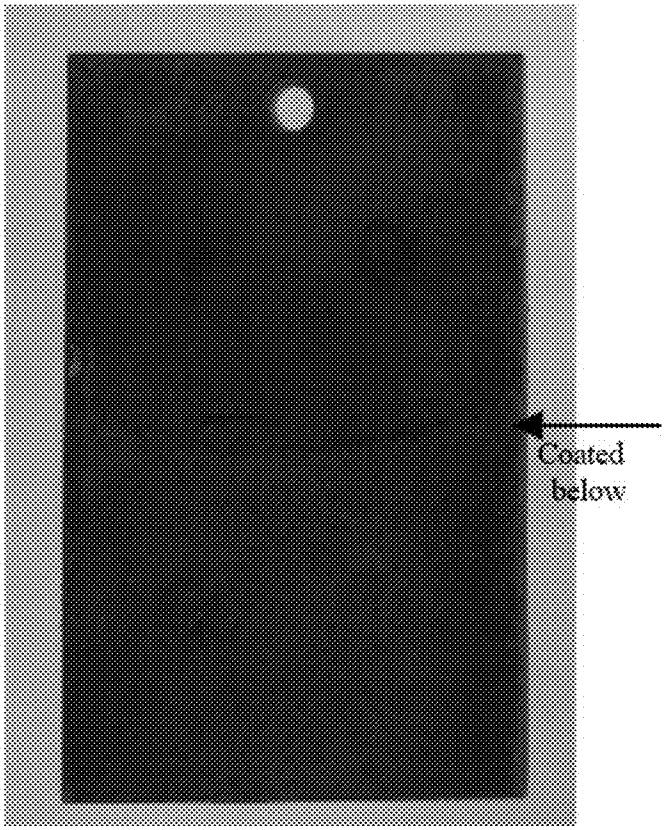
FIG. 6 depicts one embodiment showing yttrium nitrate coated 409 stainless steel that was heat treated at 1700° F. for 20 hours.

As shown in FIGS. 5*a* and 5*b*, after heat treatment at 1700° F. for 20 hours, yttrium nitrate coated 304 steel still demonstrated little to no spalling and Olsen cup test did not damage the scale. However, as seen in FIG. 6, there seemed to be little to no improvement in oxidation resistance in the yttrium nitrate coated bottom section of a 409 stainless steel coupon. A temperature of 1700° F. is quite high for 409 grades and severe oxidation was anticipated. Yttrium may be unable to slow down the iron diffusion to the surface and thus provides little beneficial protection at this high temperature. This ineffectiveness on 409 stainless steel at 1700° F. for such a long time was observed with Minimox coating also.

Example 4

Figures 7D, 7E, 7F:
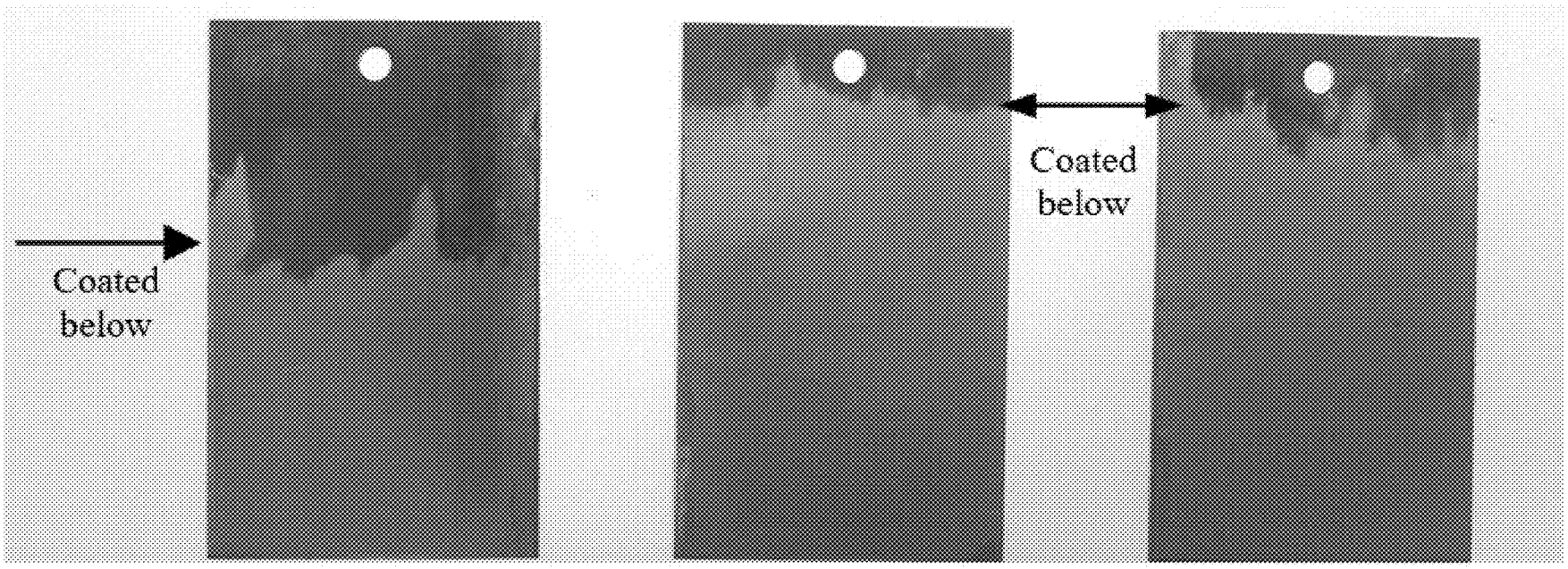
FIG. 7*d* depicts another embodiment showing yttrium nitrate coated 409 stainless steel.
FIG. 7*e* depicts an embodiment showing yttrium nitrate plus the first chromium nitrate coated 409 stainless steel.
FIG. 7*f* depicts an embodiment showing yttrium nitrate plus a second chromium nitrate coated 409 stainless steel, each of which were heat treated at 1500° F. for 3 hours.

In addition, chromium nitrate was evaluated for its effect on the oxidation resistance of stainless steels. Chromium is not a rare earth metal but it is the major element in the scale of stainless steels. Its additions to the surface of stainless steels also enhance the oxidation resistance. FIG. 7*a*-7*f* show that chromium nitrate seemed to have a beneficial effect on 409 stainless steel also after 3 hours at 1500° F., when comparing the coated and uncoated sections of the two top right coupons (FIGS. 7*b* and 7*c*). However, 5 and 10% chromium oxide equivalent coatings were not as effective as 2% yttrium oxide equivalent coating when comparing the two top right coupons (FIGS. 7*b* and 7*c*) with the bottom left one (FIG. 7*d*). Chromium nitrate addition to yttrium nitrate did not further improve oxidation resistance when comparing the two bottom right coupons (FIGS. 7*e* and 7*f*) with the bottom left one (FIG. 7*d*).

Figure 8C:
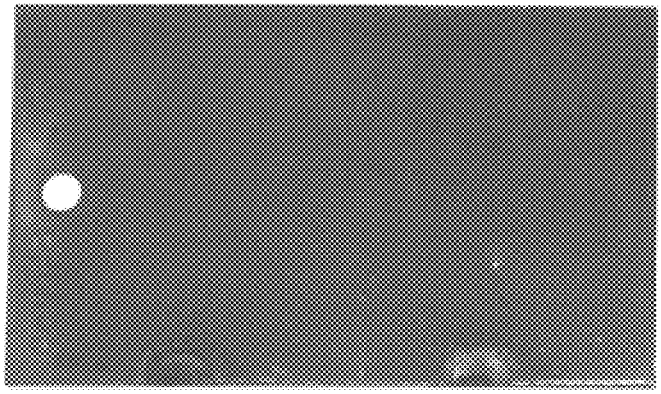
FIG. 8*c* depicts an embodiment showing the first chromium nitrate coated 409 stainless steel.
Figure 8B:
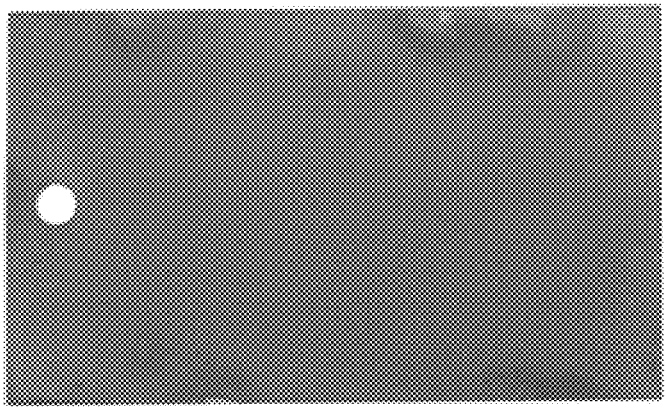
FIG. 8*b* depicts an embodiment showing yttrium nitrate coated 409 stainless steel.
Figure 8A:
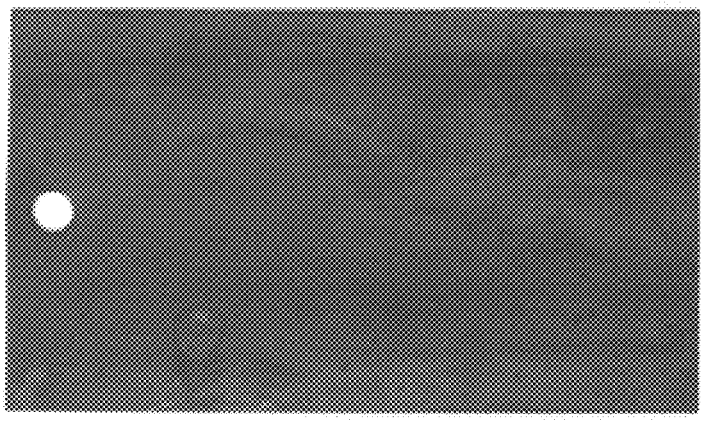
FIG. 8*a* depicts bare 409 stainless steel.
Figures 8D, 8E, 8F:
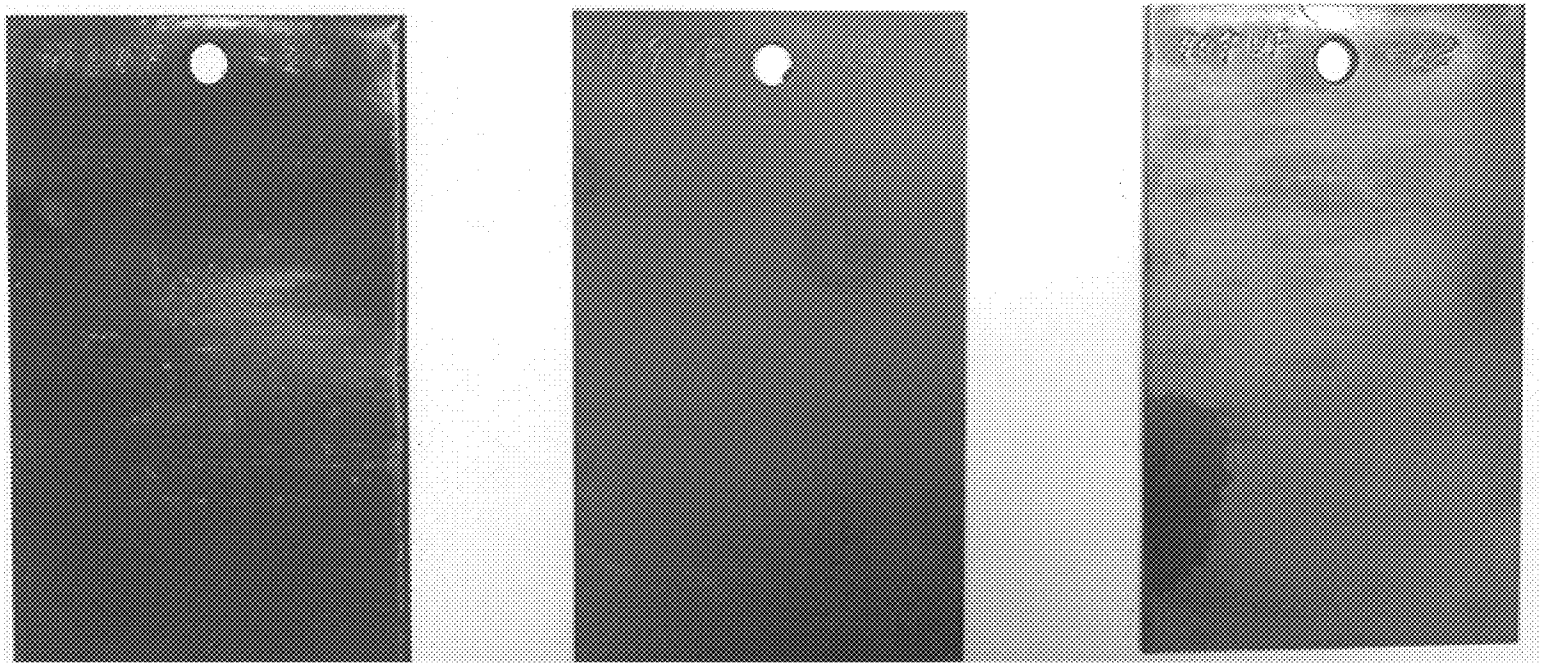
FIG. 8*d* depicts an embodiment showing the second chromium nitrate coated 409 stainless steel.
FIG. 8*e* depicts an embodiment showing yttrium nitrate plus the first chromium nitrate coated 409 stainless steel.
FIG. 8*f* depicts an embodiment showing yttrium nitrate plus the second chromium nitrate coated 409 stainless steel, each of which were heat treated at 1500° F. for 20 hours.

However, as shown in FIG. 8*a*-8*f*, when heat treated at 1500° F. for 20 hours, the addition of chromium nitrate improved the oxidation resistance of 409 stainless steel. The bare 409 stainless steel (FIG. 8*a*) exhibited severe oxidation with some spalling while the yttrium nitrate (FIG. 8*b*), chromium nitrate (FIGS. 8*c* and 8*d*) and yttrium nitrate/chromium nitrate (FIGS. 8*e* and 8*f*) developed a smooth scale without spalling. The chromium nitrate coating with 10% chromium oxide equivalent (FIG. 8*d*) showed shiny metal surface, in particular, when added with 2% yttrium oxide equivalent (FIG. 8*f*).

Example 5

Two additional sets of 409 stainless steel coupons were coated with $Y(NO_3)_3$ only, with $Cr(NO_3)_3$ (5% and 10% equivalent $Cr_2O_3$ respectively) and with $Y(NO_3)_3$ plus $Cr(NO_3)_3$ (2% $Y_2O_3$ plus 5% and 10% equivalent $Cr_2O_3$ respectively) along with an uncoated coupon, subject to heat treatment at 1500° F. for lengthy periods of time.

The first batch was treated for approximately 115 hours. While the two $Cr(NO_3)_3$ coated coupons showed limited improvement in oxidation, the $Y(NO_3)_3$ and $Y(NO_3)_3$ plus $Cr(NO_3)_3$ (2% $Y_2O_3$ plus 5% and 10% equivalent $Cr_2O_3$ respectively) coated coupons showed clear improvement. The $Y(NO_3)_3$ plus $Cr(NO_3)_3$ (2% $Y_2O_3$ plus 5% and 10% equivalent $Cr_2O_3$ respectively) coated did not seem to show further improvement in the oxidation over that coated with $Y(NO_3)_3$ only.

The second batch was treated for approximately 260 hours. While the two $Cr(NO_3)_3$ coated coupons show almost no improvement in oxidation, the $Y(NO_3)_3$ and $Y(NO_3)_3$ plus $Cr(NO_3)_3$ (2% $Y_2O_3$ plus 5% and 10% equivalent $Cr_2O_3$ respectively) coated still show apparent improvement. The $Y(NO_3)_3$ plus $Cr(NO_3)_3$ (2% $Y_2O_3$ plus 5% and 10% equivalent $Cr_2O_3$ respectively) coated seem to demonstrate similar improvement in the oxidation to that coated with $Y(NO_3)_3$ only.

What is claimed is:

1. An oxidation and corrosion resistant stainless steel comprises a coating further comprising an aqueous solution of a rare earth metal nitrate or acetate having a grain size of greater than 100 nm and a surfactant, wherein, upon drying and heating of said coating, an oxide is formed on the steel having a density of 300 to 3000 $\mu g/m^2$.

2. The oxidation and corrosion resistant stainless steel of claim 1, the coating further comprising at least one of a chromium acetate, nitrate, or sulfate, or an aluminum acetate, nitrate, or sulfate.

3. A method of increasing the oxidation and corrosion resistance of a surface of a stainless steel comprising the steps of preparing a solution by dissolving a rare earth metal nitrate or acetate having a grain size of greater than 100 nm and a surfactant in water, applying the solution to the surface of the stainless steel, drying said solution to form a continuous film of rare earth metal nitrate or acetate on said surface, and heating said stainless steel after the solution has dried so that an oxide is formed on the steel having a density of 300 to 3000 $\mu g/m^2$.

4. The method of claim 3, further comprising the step of dissolving at least one of a chromium acetate, nitrate, or sulfate, or an aluminum acetate, nitrate, or sulfate in said solution before the applying step.

* * * * *